US007469622B2

(12) United States Patent
Nishimura et al.

(10) Patent No.: US 7,469,622 B2
(45) Date of Patent: Dec. 30, 2008

(54) PAPER CUTTING MACHINE HAVING MOVABLE REST

(75) Inventors: Kazuo Nishimura, Ishikawa (JP); Toshiyuki Majima, Ishikawa (JP)

(73) Assignee: Daido Kogyo Co., Ltd., Ishikawa (JP)

( * ) Notice: Subject to any disclaimer, the term of this patent is extended or adjusted under 35 U.S.C. 154(b) by 341 days.

(21) Appl. No.: 10/544,672

(22) PCT Filed: Jan. 21, 2005

(86) PCT No.: PCT/JP2005/000771

§ 371 (c)(1),
(2), (4) Date: Aug. 4, 2005

(87) PCT Pub. No.: WO2005/090028

PCT Pub. Date: Sep. 29, 2005

(65) Prior Publication Data

US 2006/0130626 A1 Jun. 22, 2006

(30) Foreign Application Priority Data

Mar. 18, 2004 (JP) ..... 2004-077995

(51) Int. Cl.
*B26D 1/02* (2006.01)

(52) U.S. Cl. ..... 83/638; 83/658; 83/539

(58) Field of Classification Search ..... 83/638, 83/658, 566, 694, 466, 728, 637, 644, 646, 83/539–541, 659
See application file for complete search history.

(56) References Cited

U.S. PATENT DOCUMENTS

| | | | | | |
|---|---|---|---|---|---|
| 1,926,669 | A * | 9/1933 | Dodd | 83/377 |
| 2,017,622 | A * | 10/1935 | Hawkes | 83/389 |
| 3,468,200 | A * | 9/1969 | Brestel et al. | 83/62 |
| 3,580,123 | A * | 5/1971 | Westra et al. | 83/380 |
| 4,207,667 | A * | 6/1980 | D'Angelo et al. | 29/417 |
| 4,328,729 | A * | 5/1982 | Bartesaghi | 83/568 |
| 5,018,418 | A * | 5/1991 | Nasu | 83/177 |
| 5,408,908 | A * | 4/1995 | Rosenthal et al. | 83/584 |
| 7,077,042 | B2 * | 7/2006 | Nogawa et al. | 83/466 |
| 2002/0020274 | A1 * | 2/2002 | Zscheile | 83/638 |

FOREIGN PATENT DOCUMENTS

JP 2003-191196 7/2003

* cited by examiner

*Primary Examiner*—Boyer D. Ashley
*Assistant Examiner*—Laura M. Lee
(74) *Attorney, Agent, or Firm*—Wenderoth, Lind & Ponack, L.L.P.

(57) ABSTRACT

A paper cutting machine is provided for cutting a plurality of sheets of paper stacked one upon another on a table, including a paper support (2) that moves down from above along longitudinal beams (19, 19) and a cutter (3) that moves up from below in an oblique direction. The paper support (2) has a rest (18) for receiving a cutting edge of the cutter. The rest (18) is moved in a predetermined pitch whenever the number of strokes of the cutter (3) reaches a predetermined number. Accordingly, even when the cutting edge of the cutter cuts into the rest and becomes deteriorated, the cutter need not be exchanged immediately, the life of the rest can be lengthened and the number of sheets cut before exchange is necessary can be drastically improved.

4 Claims, 9 Drawing Sheets

PAPER CUTTING MACHINE HAVING MOVABLE REST

TECHNICAL FIELD

The present invention relates to a cutting machine for cutting a plurality of sheets of paper, etc, stacked one upon another. More particularly, the invention relates to a cutting machine for cutting paper, etc, that has a cutting edge rest on a paper support frame.

BACKGROUND ART

Generally, a paper cutting machine detects and controls a movement stop position of a cutting edge of a cutter blade by a limit switch, and has a rest for receiving the cutting edge so as not to create uncut portions of sheets of paper. A paper cutting machine having such a cutting edge rest is described in WO2004/096506 filed by the applicant of this application, for example. This paper cutting machine includes a stop mechanism for the cutting edge and prevents the cutting edge from excessively cutting into a rest surface of a paper support.

To prevent the occurrence of the uncut portions of the sheets of paper, however, the cutting edge must cut into the rest surface to a certain extent and when cutting is conducted hundreds of times, the cutting edge receiving surface of the rest becomes unavoidably deteriorated and quality of the cut surface unavoidably drops. It is therefore necessary to remove the rest, to adjust its position and to again fit a new cutting edge receiving surface, thereby impeding an efficient cutting operation. Needless to say, the rest must be replaced by a new one when the cutting edge receiving surface becomes deteriorated as a whole.

DISCLOSURE OF INVENTION

Problems that the Invention is to Solve

It is therefore an object of the invention to provide a paper cutting machine that automatically moves a rest before a cutting edge receiving surface of the rest of a paper support becomes deteriorated due to the cutting edge of a cutter blade without the necessity for frequent exchange of the rest, that maintains the quality of the cut surface of sheets of paper and that can conduct an efficient cutting operation.

Means to Solve the Problems

In a paper cutting machine according to the present invention, a cutter blade is arranged below a paper support, the paper support for supporting sheets of paper from above has a rest for receiving a cutting edge of the cutter blade and the cutting apparatus cuts the sheets of paper by the cutter blade that moves up. This paper cutting machine cuts the sheets of paper by moving the cutter blade upwardly in an oblique direction lest positioning errors of a plurality of sheets of paper occur. Because the sheets of paper are cut one by one from below and paper scraps fall naturally, the paper scraps do not remain around the rest and do not adhere to the cutting edge.

In the paper cutting machine according to the invention, the cutter blade for cutting a plurality of sheets of paper that are stacked cuts the sheets of paper while obliquely moving along guide grooves inclined in the longitudinal direction of the cutter blade. The paper support has a paper support frame and the rest fitted to the paper support frame and can move along a pair of longitudinal beams extending in a vertical direction.

When the final sheet of paper is cut, the cutting edge of the cutter blade cuts into an edge receiving surface of the rest but the cutting machine of the invention has a function of slightly moving the rest whenever the cutter blade has undergone a predetermined number of strokes. However, the cutting machine has a clamp construction so that the rest of the paper support does not move during the cutting operation.

In other words, in a paper cutting machine for cutting a plurality of sheets of paper stacked one upon another on a table, including a main body frame having a pair of longitudinal beams extending in a vertical direction, a paper support moving up and down along the longitudinal beams, for supporting sheets of paper from above, and a cutter blade moving up and down in an oblique direction, moving up from below and cutting the sheets of paper, wherein the paper support has a rest coming into contact with the uppermost sheet of paper and receiving a cutting edge of the cutter blade, and a paper support frame for supporting the rest fitted to the lower surface thereof, meshing with the longitudinal beams, the paper cutting machine having a movable rest according to the invention includes a moving mechanism for moving the rest by a predetermined pitch in a direction perpendicular to imaginary extensions of the surfaces defining the thickness of the cutter blade, and a controller for operating the moving mechanism whenever the cutter blade reaches a predetermined number of strokes.

The function of moving the rest little by little whenever the number of strokes of the cutter blade reaches the predetermined number of strokes is performed by a moving mechanism of the rest and a controller for operating the moving mechanism whenever the cutter blade reaches the predetermined number of strokes. The controller includes counting means for counting the number of strokes of the cutter blade and operation means for controlling so as to operate the moving mechanism.

The counting means of the number of strokes of the cutter blade may be a known counting means. For example, the counting means may be means for counting the number of strokes of the cutter blade moving up and down by detecting the position of the cutter blade by using an optical sensor or counting means that detects a plurality of stacked sheets of paper by using an optical sensor in a route till the sheets of paper reach a table of the cutting apparatus, and regards the number of times of passage of the plurality of stacked sheets as the number of strokes. However, the counting means need not be limited to these means. In such a case, a device for adding the number of strokes may be of a known type and is not particularly limited. For example, the device may be an adder using a computer.

When the number of strokes counted by the counting means of the controller described above reaches the predetermined number, the operation means of the controller causes the moving mechanism of the rest to operate. This operation means may be the one that has the function of operating the moving mechanism of the rest and corresponds to the construction of the rest moving mechanism. For example, when the rest moving mechanism generates driving force by a solenoid, the operation means of the controller is means for applying a current to the solenoid.

Here, a concrete construction of the moving mechanism of the rest is not particularly limited as long as it operates at a predetermined number of strokes of the cutter blade and moves in a predetermined pitch. The term "predetermined number of strokes" means a critical number of times at which the cutting edge receiving surface of the rest gets deteriorated and cutting cannot be made correctly, and the distance of the moving pitch is within the range in which the cutting edge receiving surface adjacent to the deteriorated cutting edge surface does not affect the cutting operation. An example of the rest moving mechanism includes a solenoid fitted to a paper support frame, a rack interconnected to a rod as a movable core of the solenoid, a one-way clutch gear meshing with the rack, a rest rack formed on the rest fitted to the lower surface of the paper support frame in such a manner as to be capable of sliding, and a pinion gear meshing with the rest rack and capable of rotation upon acquiring power of the one-way clutch gear.

To clamp the rest, the paper cutting machine further includes a movable clamp mechanism having elastic bodies on both sides of the paper support frame for clamping the rest and a stopper bracket fitted to the main body frame, wherein the movable clamp mechanism completely fixes the rest when the paper support exists at a position for supporting the sheets of paper, and comes into contact with the stopper bracket, releases clamping of the rest and allows the rest to slide when the paper support frame moves up and reaches a position near an upper dead point.

The movable clamp mechanism described above preferably includes a spring guide pin inserted movably in the vertical direction into a through-hole formed on each side of a horizontal portion of the paper support frame in such a manner that a head thereof exists at the upper end, a spring fitted to an upper part of the spring guide pin higher than a horizontal portion of the paper support frame, and a receiving portion fitted to the lower end of each spring guide pin. According to this construction, the receiving portions biased by the spring serve to support and clamp both ends of the rest.

The material of the rest is a resin (for example, polypropylene) having a hardness suitable for maintaining cutting quality of the cutter blade for a long time, and both ends of the rest must be reliably clamped by spring force, etc lest the rest deviates during cutting of the sheets of paper. When the rest made of the resin is clamped by the receiving portions made of a metal, a large clamping force is applied because a coefficient of friction between the resin and the metal is generally small. Therefore, the problem of deformation and breakage of the rest made of the resin occurs.

In the invention, therefore, both end portions of the rest are preferably made of a metal having a greater coefficient of friction than the resin. More concretely, a metal sheet is fixed by a screw to both ends of the rest main body made of the resin, and this metal sheet is clamped by the receiving portion. A U-shaped groove is formed in the metal sheet and the spring guide described above penetrates through this U-shaped groove in such a manner as to be capable of sliding. The rest can slide when the paper support frame moves up and reaches a position near the upper dead point and the metal sheet is clamped by the receiving portion when the paper support exists at the paper supporting position, thereby completely fixing the rest. According to this construction, the clamping force can be made relatively small and the rest can be reliably fixed without inviting its deformation and breakage.

ADVANTAGES OF THE INVENTION

In the invention, the rest of the paper support automatically moves in the predetermined pitch when the cutter blade reaches the predetermined number of strokes. Consequently, the paper cutting surface does not become dull with deterioration of the cutting edge receiving surface and fluff does not occur on the cutting surface. Even when the cutting edge of the cutter blade cuts into the rest and becomes deteriorated, the cutting edge need not be immediately replaced because the position of the rest the cutting edge strikes is changed by moving the rest little by little. The life of the rest can be thus prolonged, the number of the sheets of paper cut before exchange is necessary drastically increases and eventually, the cutting cost can be decreased.

DETAILED DESCRIPTION OF THE INVENTION

The paper cutting machine according to the embodiment of the invention is constituted in such a manner as to clamp sheets of paper stacked by a paper support and to cut them one by one from below. Because the cutter blade is pushed up obliquely, the sheets of paper can be cut one by one from below and paper scraps after cutting naturally fall and do not adhere to the cutting edge of the cutter blade.

It has been observed that the cutting resistance of the cutting machine for cutting a large number of cut materials stacked (sheet bundles, stacked sheets of paper, metal foils, thin metal sheet layers) irregularly changes depending on fluctuation of compressive elasticity as a deformation amount of the cut materials cut by a cutting tool and fluctuation of frictional force. To drive such a cutting machine by a driving motor, etc, it is necessary to set driving force of the driving motor on the basis of a maximum cutting resistance and also to set rigidity of the cutting machine itself on the basis of the maximum cutting resistance.

Figure 2:
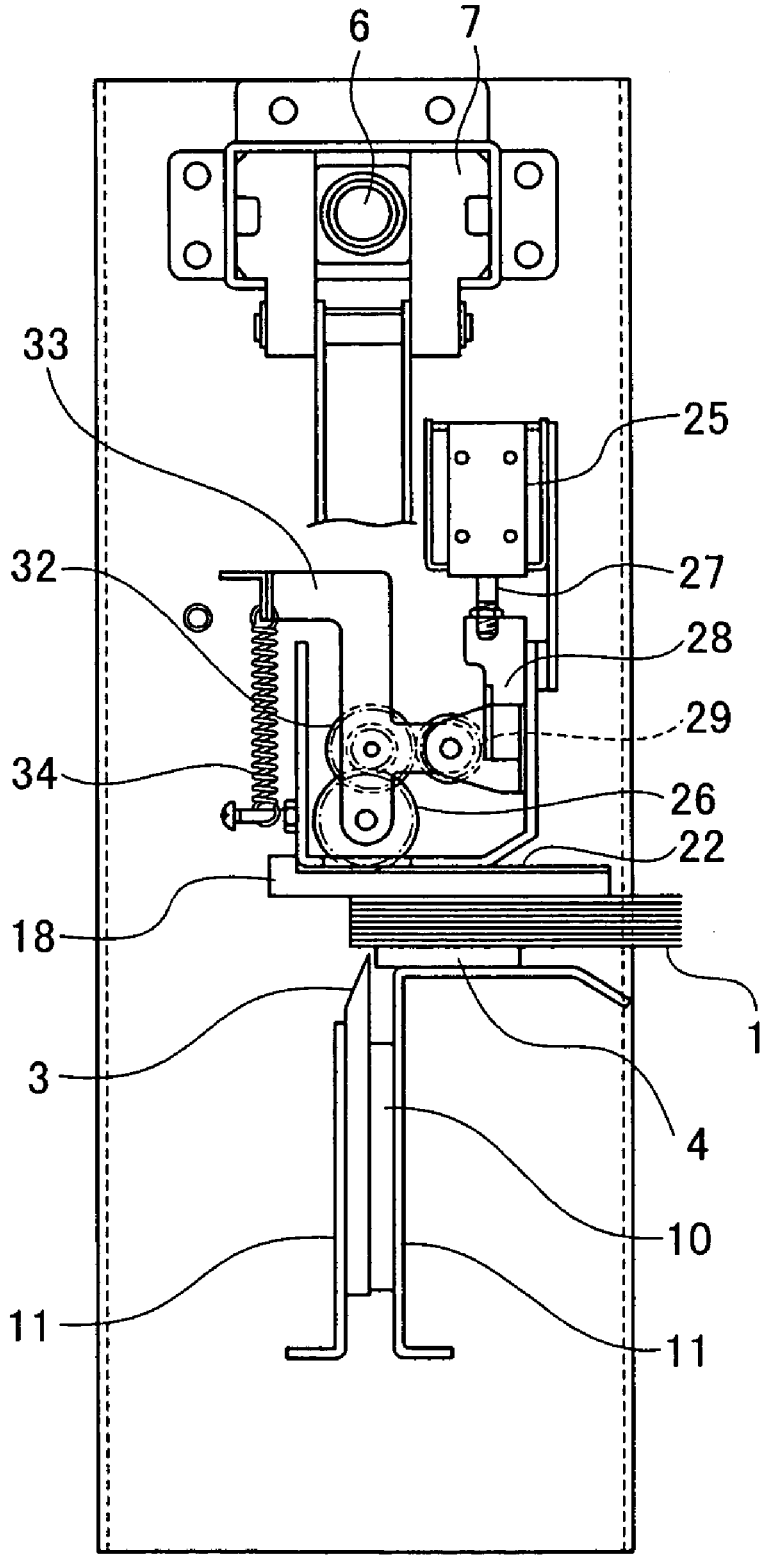
FIG. 2 is a longitudinal sectional view of the paper cutting machine according to the invention.

The drawings show a cutting machine according to an embodiment of the invention. The cutting machine includes a paper support 2 for supporting a plurality of sheets of paper 1 stacked lest their positions deviate, and a cutter blade 3 for cutting the sheets of paper 1. The stacked sheets of paper 1 are put on a flat table 4. The paper support 2 moves down from above and firmly clamps the sheets of paper 1 lest their positions deviate when they are cut. As shown in FIG. 2, the cutter blade 3 has spaced apart surfaces defining its thickness, and a cutting edge at its upper end.

The paper support 2 has a rest 18 and a paper support frame 20 that has a bracket sectional shape and maintains contact with the sheets of paper throughout its entire width. The paper support frame 20 is connected by links 5 and 5 that are disposed equidistantly to a center shaft. The links 5 and 5 are connected to nuts 7 and 7 meshing with screws 6 through shafts 8 and 8. The distance between the nuts 7 and 7 respectively meshing with the screws 6 changes when the screws 6 rotate. Accordingly, the inclination of the links 5 and 5 connected to the paper support frame 20 through the shafts 8, 8, 9 and 9 changes.

Figure 1:
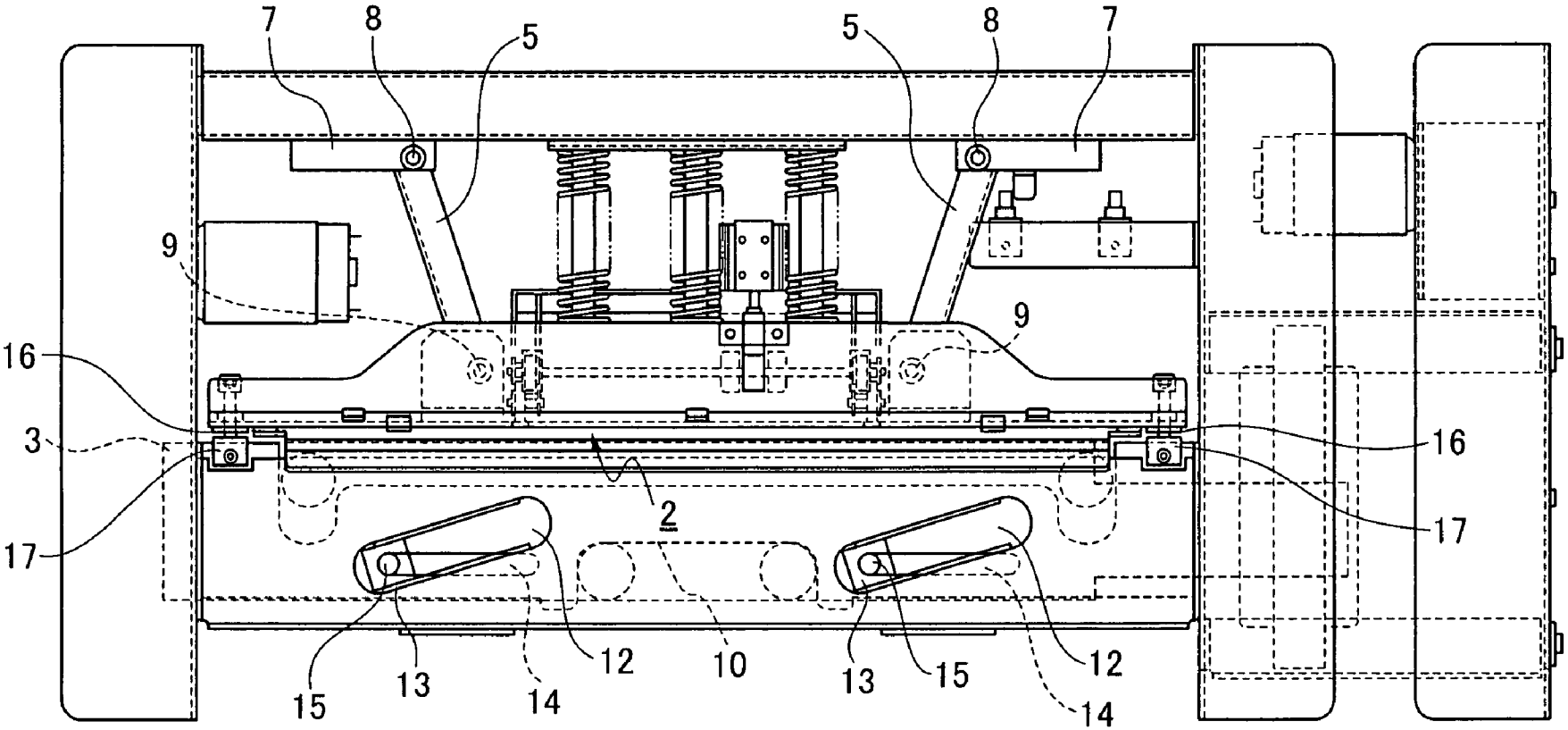
FIG. 1 is a front view showing a paper cutting machine according to an embodiment of the invention.

When the gap between the nuts 7 and 7 decreases in FIG. 1, the paper support 2 moves down and pushes the stacked sheets of paper 1. Because the paper support 2 is guided at its both ends by a pair of longitudinal beams 19 and 19, it moves up and down with the movement of the nuts 7 and 7 when the screws 6 rotate but does not move in the transverse direction. The screw 6 is driven for rotation by a motor and rotates slowly while its rotating speed is lowered by a plurality of gears interposed between the screw 6 and the motor. A coil spring imparts spring force that pushes down the paper support 2. The coil spring is stretched when the links 5 and 5 move toward their vertical posture and the paper support 2 moves down.

Since the paper support in the invention employs the combination of the gear mechanism and the link mechanism, the paper support can firmly clamp the sheets of paper 1 when a motor corresponding to 25 W at DC 24 V, for example, is used. The inclination θ of the links 5 and 5 can be detected by detecting the positions of the nuts 7 and 7. As a result, the thickness of the sheets of paper 1 supported by the paper support 2 can be detected and the moving distance of the cutter blade 3 can be controlled smoothly.

On the other hand, the cutter blade 3 is fitted below the paper support 2 such that it maintains surface contact with a cutter table 10, and slides between guides 11 and 11. Moreover, the sliding direction of the cutter blade 3 is obliquely vertical, two guide grooves 12 and 12 are respectively formed in the guides 11 and 11 with a predetermined gap between them and these guide grooves 12 and 12 are inclined obliquely.

Sliders 13 and 13 are fixed to a shaft pin penetrating through the cutter blade 3 and through the cutter table 10, and theses sliders 13 and 13 are fitted in the guide grooves. Therefore, when the sliders 13 and 13 slide along the guide grooves 12 and 12, the cutter blade 3 slides obliquely. However, the cutter blade 3 moves while being always kept horizontal because the sliders 13 and 13 slide while being fitted to both guide grooves 12 and 12 that are formed in parallel with each other. When the sliders 13 and 13 move toward the extreme left of the inclined guide grooves 12 and 12, the cutter blade 3 moves down but when the sliders 13 and 13 slide and move to the right, the cutter blade 3 moves up.

On the other hand, elongated apertures 14 and 14 are formed in the cutter table 10 with which the cutting edge of the cutter blade 3 maintains surface contact. Shaft pins 15 and 15 are fitted into the elongated apertures 14 and 14. Therefore, when the sliders 13 and 13 move in the oblique direction along the guide grooves 12 and 12, the cutter blade 3 moves in the oblique direction along the guide grooves 12 and 12 but the cutter table 10 moves up and down in the vertical direction.

Incidentally, the specific means for moving the cutter blade 3 and the cutter table 10 up and down is not particularly limited. For example, a screw can be fitted horizontally below the cutter blade 3 and driven for rotation by a motor through a plurality of gears, and a nut meshing with this screw moves with the rotation of the screw. In such an arrangement, the movement of the nut resulting from the rotation of the screw is transmitted to the sliders 13 and 13.

Consequently, the cutter blade 3 is pushed up in the oblique direction along the guide grooves 12 and 12 and cuts one by one from below the sheets of paper 1 clamped by the paper support 2. Because the sheets of paper 1 are cut one by one, the paper scraps fall without rubbing the surface of the cutting edge and do not adhere to the cutting edge. In this cutting operation, the paper support 2 firmly clamps the sheets of paper 1 through the links 5 and 5 lest their positions deviate because the cutter blade 3 also moves in the horizontal direction simultaneously with its ascension.

In the cutting machine according to the invention, the cutter blade 3 moves up and cuts the clamped sheets of paper 1 and the cutting edge of the cutter blade 3 slightly enters the cutting edge receiving surface of the support member of the paper support 2. Stoppers 16 and 16 are fitted to both sides of the paper support 2 lest parts of the sheets of paper 1 are left uncut because the cutting edge does not reach the cutting edge receiving surface, or the cutting edge of the cutter blade 3 excessively enters the cutting edge receiving surface, on the contrary.

Because the stoppers 16 and 16 employ a screw mechanism, their distal end positions are adjustable. Stopper tables 17 and 17 are mounted to the cutter table 10 with which the cutter blade 3 maintains surface contact. When the cutter blade 3 moves up, the stopper tables 17 and 17 come into contact with the stoppers 16 and 16 fitted to the paper support 2 and inhibit ascension of the cutter blade 3. The cutter blade 3 moves up in the oblique direction but the cutter table 10 moves up in the vertical direction and the stopper tables 17 and 17 come into contact with the stoppers 16 and 16.

As the cutter blade 3 moves up and the stopper tables 17 and 17 come into contact with the stoppers 16 and 16, a load exceeding a predetermined value operates on the motor for moving up the cutter blade 3. The motor is so controlled as to stop its rotation when the load exceeds the predetermined value and the cutter blade 3 stops without creating the uncut sheets of paper and without allowing the cutting edge of the cutter blade 3 to excessively cut into the rest of the paper support.

As described above, the cutting edge of the cutter blade 3 cuts into the cutting edge receiving surface of the rest to cut the sheets of paper 1 and as this cutting operation is repeated, the cutting edge receiving surface gets deteriorated, thereby forming a groove. As a result, the cutter blade 3 fails to correctly cut the sheets of paper 1. Therefore the invention makes the rest 18 movable. In other words, the rest 18 is allowed to slide in a predetermined pitch when the cutter blade 3 reaches a predetermined number of strokes (500 to 600, for example).

Figure 3A:
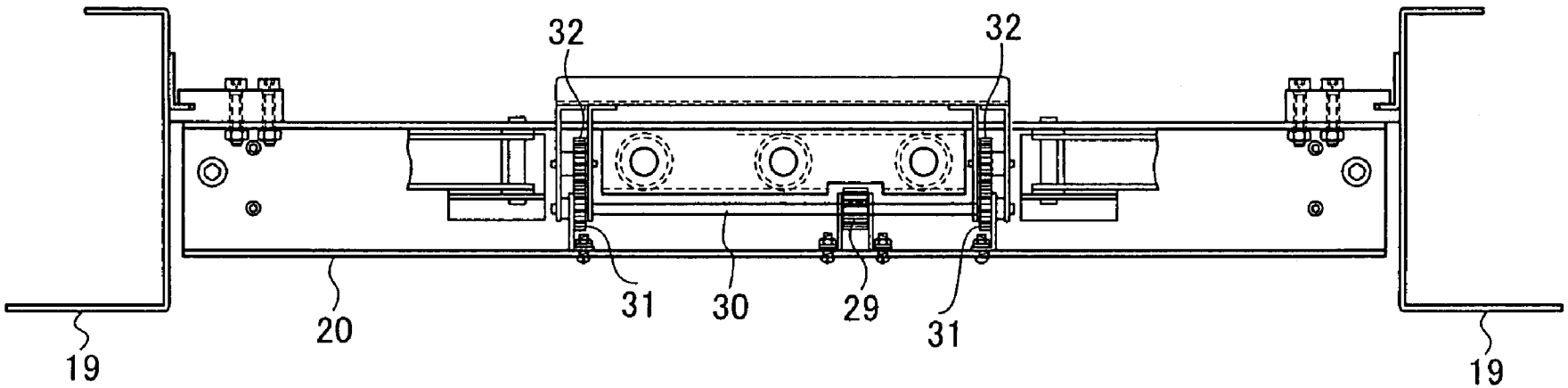
FIG. 3A is a plan view showing a driving device of a movable rest in the embodiment.
Figure 3B:
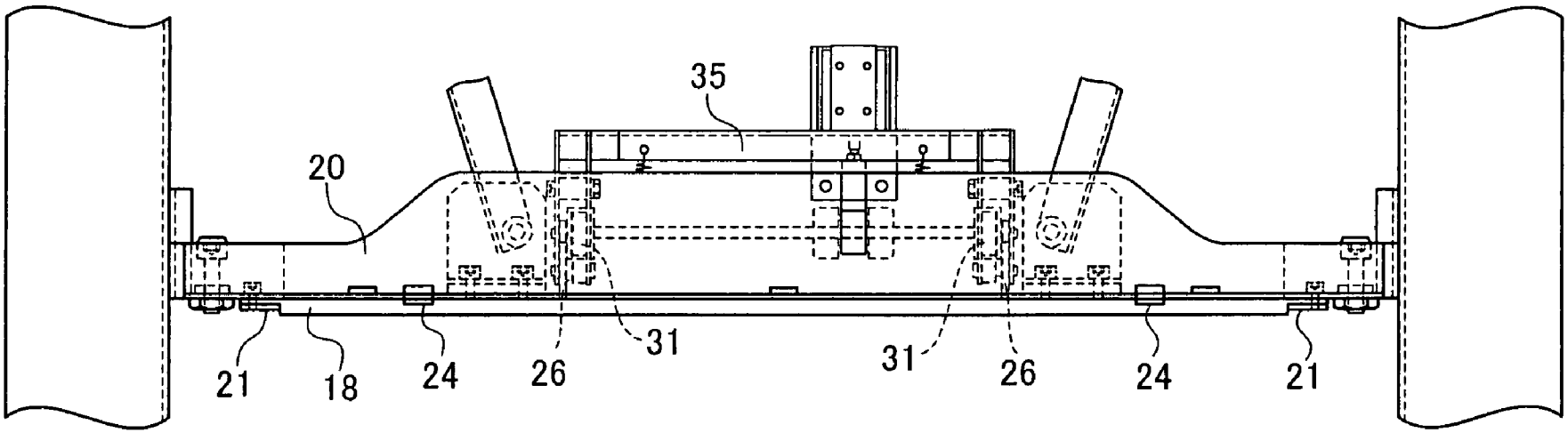
FIG. 3B is a front view showing the driving device of the movable rest in the embodiment.

The paper support frame 20 has a bracket sectional shape the upper part of which is open and both of its sides move up and down while being guided by the longitudinal beams 19 and 19 as shown in FIGS. 3A and 3B. The movable rest 18 is fitted to the lower surface of the paper support frame 20. Receiving portions 21 and 21 are fastened by screws to both sides of the lower surface and support both ends of the movable rest 18 in such a manner as to be sliding.

Figure 4A:
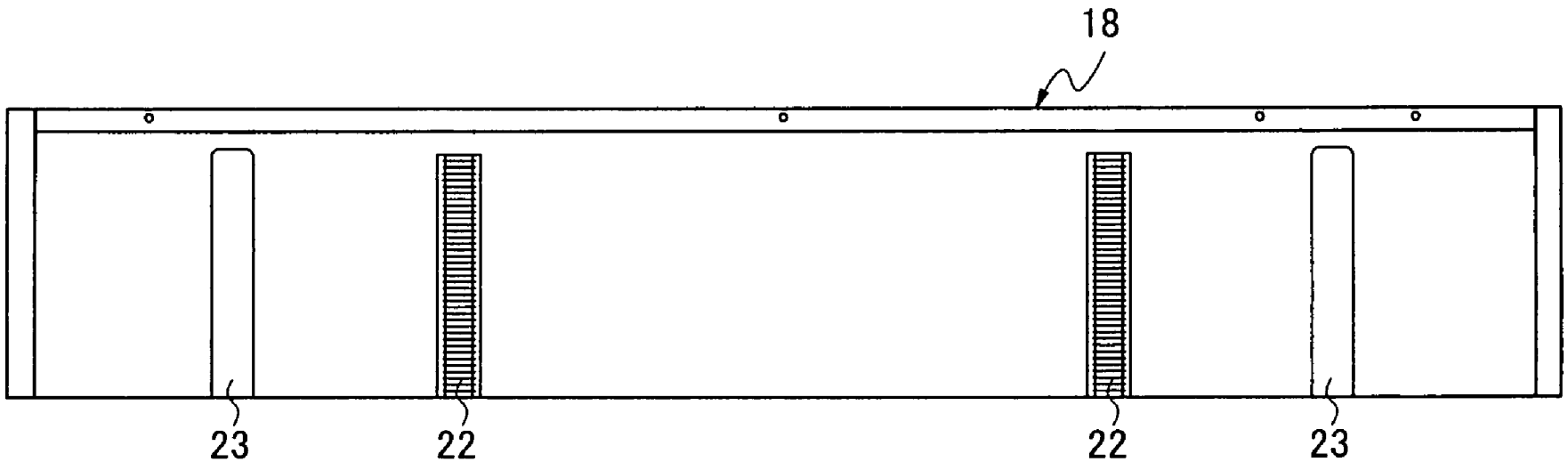
FIG. 4A is a plan view showing a concrete example of the rest.
Figure 4B:
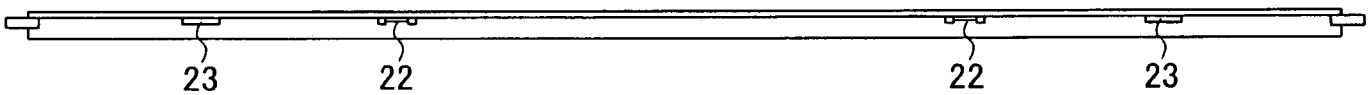
FIG. 4B is a front view showing a concrete example of the rest.
Figure 4C:
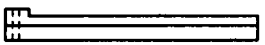
FIG. 4C is a side view showing a concrete example of the rest.
Figure 5A:
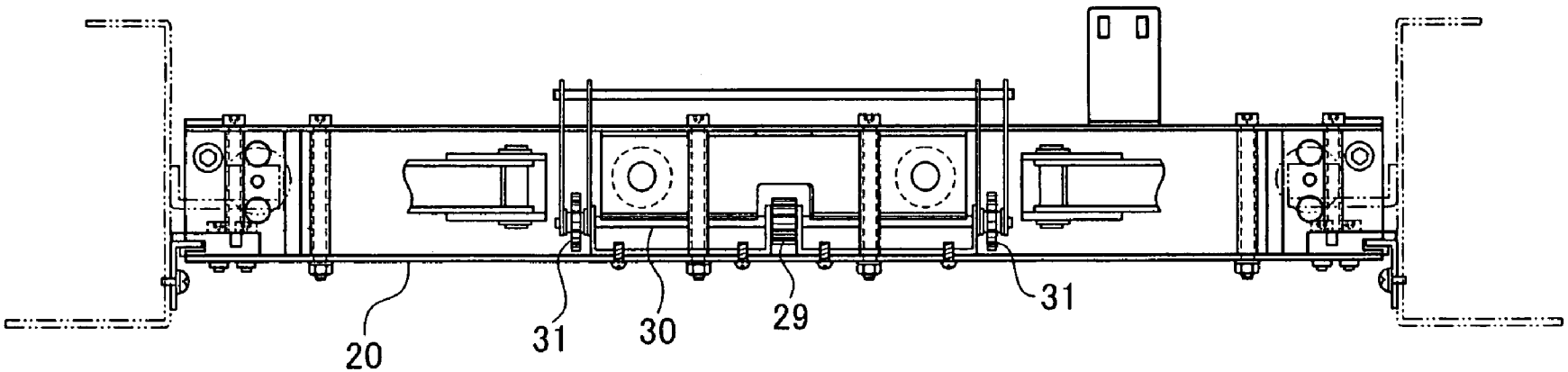
FIG. 5A is a plan view showing the driving device of the movable rest having the movable clamp mechanism in the embodiment.
Figure 5B:
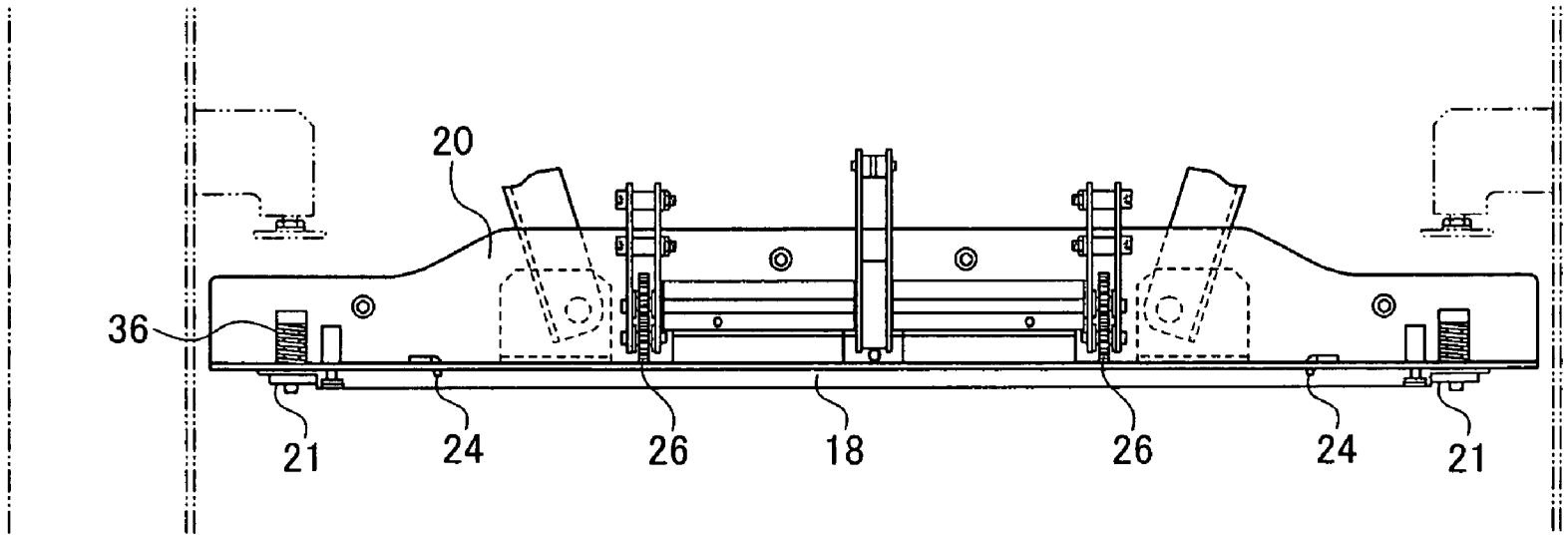
FIG. 5B is a front view showing the driving device of the movable rest having the movable clamp mechanism in the embodiment.

FIGS. 4A and 4B show the movable rest 18. The movable rest 18 is made of a resin and rest racks 22 and 22 are formed on the upper surface of the rest 18 with a predetermined gap between them. Guide grooves 23 and 23 are formed outside the rest racks 22 and 22. Guide plates 24 and 24 fitted to the lower surface of the paper support frame 20 fit into the guide grooves 23 and 23. Pinion gears 26 and 26 mesh with the rest racks 22 and 22. When the pinion gears 26 and 26 rotate, the movable rest 18 slides along the guide plates 24 and 24 in a direction perpendicular to imaginary extensions of the surfaces of the cutting blade 3.

Incidentally, this embodiment has the construction in which the pinion gears 26 are allowed to rotate by the operation of a solenoid 25 as shown in FIG. 2. The rack 28 is interconnected to a rod 27 as a movable core of the solenoid 25 and meshes with a one-way clutch gear 29. Therefore, when the solenoid 25 operates and the rack 28 moves down, the one-way clutch gear 29 rotates but when the rack 28 moves up, the one-way clutch gear 29 does not rotate.

The one-way clutch gear 29 is fitted to a shaft 30. Both ends of the shaft 30 are pivotally supported by bearings of a retaining frame 35 fitted to the paper support frame 20. Gears 31 and 31 are fitted to both ends of the shaft 30. The gears 31 and 31 mesh with gears 32 and 32, and the gears 32 and 32 mesh with the pinion gears 26 and 26 described above. The gears 31 and 32 and the pinion gear 26 are fitted to a bracket 33. The bracket 33 is supported coaxially with the gears 31 and 31 in such a manner as to be capable of swinging.

Therefore, when the solenoid 25 operates, the pinion gear 26 is rotated by operation of the rack 28, the one-way clutch 29, the gear 31 and the gear 32. When the pinion gear 26 rotates, the rest rack 22 moves, so that the movable rest 18 slides in a predetermined pitch.

As for the operation of the solenoid, a controller (not shown) having an optical sensor and a computer detects the position of the cutter by using the optical sensor and the like. Based on the detection signal, the computer calculates the number of strokes of the cutter moving up and down, and a current is applied to the solenoid 25 whenever the number of strokes reaches a predetermined number.

Here, the bracket 33 is supported coaxially with the gears 31 and 31 in such a manner as to be capable swinging and is pushed down by the spring force of the coil spring 34. In other words, the spring force is applied so that the pinion gear 26 can correctly mesh with the rest rack 22 of the movable rest 18 and does not undergo tooth jumping during driving. Therefore, both ends of the coil spring 34 are interconnected to the distal end of the bracket 33 and to the paper support frame 20.

To exchange the movable rest 18, the coil spring 34 is stretched and the bracket 33 is lifted up. In other words, the bracket 33 is lifted up while being swung with the shaft 30 of the gear 31 as the center, and under this state, the movable rest 18 can be exchanged.

As described above, the movable rest 18 is so constituted as to be capable of moving little by little with the rotation of the pinion gear 26 but can be fixed to the paper support frame 20 when the sheets of paper 1 are cut. In the embodiment shown in FIGS. 3A and 3B, the movable rest 18 is supported by the receiving portion 21 on the lower surface of the paper support frame 20. However, because the movable rest 18 has to move with the rotation of the pinion gear 26, the support structure of the movable rest 18 is not a structure that always completely clamps the movable rest 18 by the receiving portion 21.

The paper support frame 20 has variable clamp mechanisms as shown in FIGS. 5A to 6B. The variable clamp mechanisms 36 and 36 are fitted to both sides of the paper support frame 20 and have a construction in which they clamp both ends of the movable rest 18 and this clamp is released near the upper dead point when the paper support frame 20 moves up. Each of the movable clamp mechanisms 36 includes a spring guide pin 41 inserted into a through-hole disposed on each side of the horizontal portion of the paper support frame 20 in such a manner that the spring guide pin is movable upwardly and downwardly in the through-hole, and a head of the spring guide pin 41 exists at the upper end, with a spring 40 fitted above the paper support frame horizontal portion of the spring guide pin 41 and the receiving portion 21 fitted to the lower end of the spring guide pin. The receiving portion 21 biased by the spring supports and clamps each end of the rest.

Therefore, because the spring guide pin 41 is lifted up by the spring force of the spring 40, the receiving portion 21 moves up and can clamp the movable rest 18. In other words, the movable rest 18 is clamped by the receiving portion 21 biased by the spring force and the movable rest 18 can stably press the sheets of paper 1 without shaking. However, when the movable rest 18 is always clamped, it cannot slide with the rotation of the pinion gear 26.

Figure 6A:
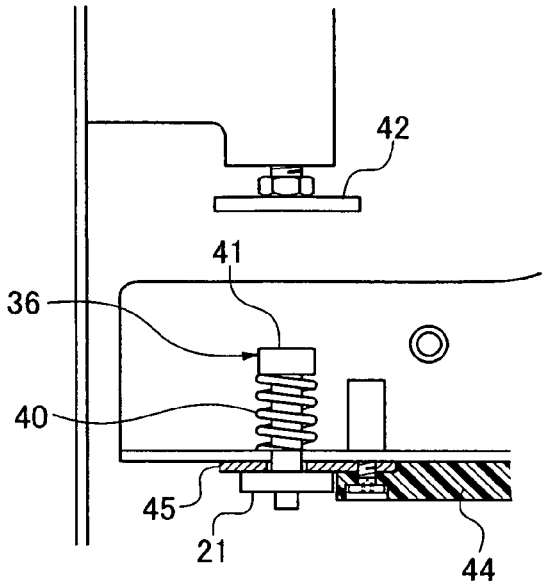
FIG. 6A is a front view showing a concrete example of the movable clamp mechanism under the state in which the rest is clamped by force of a spring.
Figure 6B:
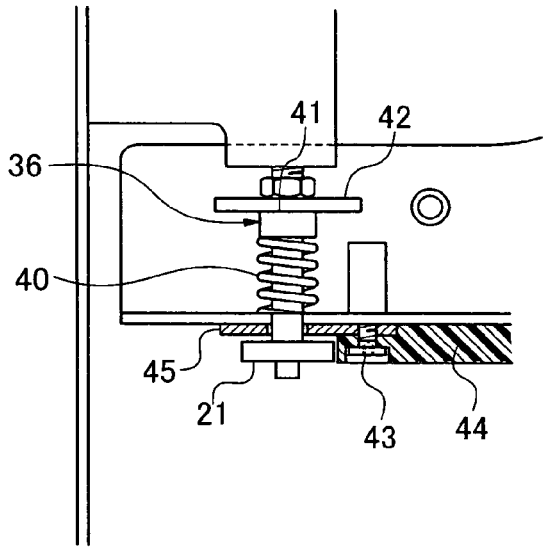
FIG. 6B is a front view showing a concrete example of the movable clamp mechanism under the state in which the rest is released from clamping by compressing the spring.

When the paper support frame 20 moves up and reaches a position near the upper dead point as shown in FIG. 6B, the head of the spring guide pin 41 comes into contact with the stopper bracket 42. As a result, the spring guide pin 41 compresses the spring 40 and pushes it down and the receiving portion 21 separates from the movable rest 18. However, the movable rest 18 does not fall because it is supported by the receiving portion 21.

When the paper support frame 20 reaches the position near the upper dead point, the pinion gear 26 starts rotating and can slide the movable rest 18. Here, the specific construction of the movable clamp mechanism 36 of the movable rest 18 is not particularly limited and any construction can be used as long as it can release clamping of the moveable rest 18 when the paper support frame 20 reaches the position near its upper dead point.

Figure 7:
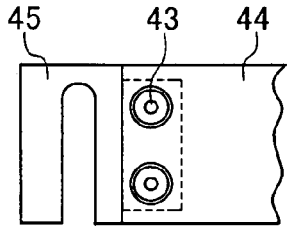
FIG. 7 is a plan view showing in detail an end portion of the rest.

The rest 18 is formed by fixing a metal sheet 45, by use of a screw, to each end of a rest main body 44 made of a resin as shown in FIGS. 6A, 6B and 7. A U-shaped groove is formed in this metal sheet 44 and the spring guide pin 41 penetrates through the U-shaped groove in such a manner as to be capable of sliding. Consequently, the rest 18 is allowed to slide. When the metal sheet is clamped by the metallic receiving portion 21, the rest 18 can be completely fixed by a relatively small clamping force. Because both ends of the rest 18 clamped by the receiving portion 21 are formed of the metal sheet 44, the problem of deformation and breakage does not occur.

INDUSTRIAL APPLICABILITY

As described above, the cutting machine according to the invention is particularly useful for the paper cutting apparatus having the construction in which the cutter is disposed below the paper support, the rest for receiving the cutting edge of the cutter is provided to the paper support for supporting the sheets of paper from above and the cutter moving up cuts the sheets of paper. However, the invention can be suitably applied to cutting apparatuses of sheet bundles, stacked paper, metal foils, metal sheet layers, and so forth, as long as the cutting apparatuses use the rising cutter and the rest for the cutting operation.

The invention claimed is:

1. A paper cutting machine for cutting a plurality of sheets of paper stacked one upon another on a table, including a main body frame having a pair of longitudinal beams extending in a vertical direction; a paper support that is movable up and down along the longitudinal beams between upper and lower limit positions, for supporting sheets of paper from above; and a cutter that is movable up and down in an oblique direction, and is movable up from below to cut the sheets of paper, the cutter blade having surfaces spaced from each other defining its thickness and having a cutting edge at an upper end thereof; said paper support including a rest arranged to move into contact with the uppermost sheet of paper and receive said cutting edge of the cutter blade, and a paper support frame meshing with the longitudinal beams and arranged for supporting the rest fitted to the lower surface thereof;

said paper cutting machine comprising:

a moving mechanism for allowing said rest to move by a predetermined pitch in a direction perpendicular to imaginary extensions of said surfaces of the cutter blade; and a controller for operating the moving mechanism whenever the number of strokes of the cutter blade reaches a predetermined number of strokes;

wherein the rest is arranged to move by the predetermined pitch in the direction perpendicular to the imaginary extensions whenever the number of strokes of the cutter blade for cutting the sheets of paper reaches the predetermined number; and wherein said moving mechanism of the rest includes a solenoid fitted to the paper support frame, a rack interconnected with a rod constituted by a movable core of the solenoid, a one-way clutch gear meshing with the rack, a rest rack formed on the rest, wherein the rest is fitted to the lower surface of the paper support frame in such a manner as to be capable of sliding, and a pinion gear meshing with the rest rack and capable of rotation upon acquiring power of the one-way clutch gear.

2. A paper cutting machine as defined in claim 1, further comprising:

a movable clamp mechanism having elastic bodies on both sides of the paper support frame for clamping the rest; and a stopper bracket fitted to the main body frame;

wherein the movable clamp mechanism completely fixes the rest when the paper support frame exists at a position for supporting the sheets of paper, and comes into contact with the stopper bracket, releases the rest from clamping and allows the rest to slide when the paper support frame moves up and reaches a position near the upper limit position thereof.

3. A paper cutting machine as defined in claim 2, wherein said movable clamp mechanism includes spring guide pins vertically movably disposed in through holes formed on sides of a horizontal portion of the paper support frame, wherein each of said spring guide pins includes a head at an upper end, wherein a spring is fitted to an upper part of each of the spring guide pins higher than a horizontal portion of the paper support frame, wherein a receiving portion is fitted to the lower end of each of said spring guide pins, and wherein the receiving portions are biased by the springs so as to support and clamp both ends of the rest.

4. A paper cutting machine as defined in claim 3, wherein said rest includes a rest main body portion formed of a resin and metal sheets fixed by screws to both ends of the rest main body portion, each of the metal sheets has a U-shaped groove through which one of the spring guide pins penetrates in such a manner as to be capable of sliding and is supported and clamped by a respective one of the receiving portions.

* * * * *